US008337038B2

(12) United States Patent
Krause

(10) Patent No.: US 8,337,038 B2
(45) Date of Patent: Dec. 25, 2012

(54) SOLAR POWERED CANDLE

(76) Inventor: Damian Krause, New York, NY (US)

( * ) Notice: Subject to any disclaimer, the term of this patent is extended or adjusted under 35 U.S.C. 154(b) by 331 days.

(21) Appl. No.: 12/779,603

(22) Filed: May 13, 2010

(65) Prior Publication Data

US 2011/0280009 A1 Nov. 17, 2011

(51) Int. Cl.
*F21L 4/00* (2006.01)
*F21L 13/00* (2006.01)

(52) U.S. Cl. ..... 362/183; 362/161; 362/192; 362/647

(58) Field of Classification Search ..... 362/183, 362/649, 647, 640, 209, 192, 161, 157; 200/6 R, 200/7, 8 R, 51.16
See application file for complete search history.

(56) References Cited

U.S. PATENT DOCUMENTS 4,816,970 A * 3/1989 Garcia, Jr. ..... 362/183
5,036,443 A * 7/1991 Humble et al. ..... 362/183
6,082,877 A * 7/2000 Hughes ..... 362/360
6,926,423 B2 8/2005 Bucher
7,093,949 B2 8/2006 Hart
7,360,918 B2 4/2008 Trombetta
7,377,667 B2 5/2008 Richmond
2003/0035291 A1 2/2003 Jensen
2004/0252492 A1 12/2004 Peterson

* cited by examiner

*Primary Examiner* — Danielle Allen

(74) *Attorney, Agent, or Firm* — Marguerite Del Valle

(57) ABSTRACT

A solar powered light device having a shade having an upper edge, an interior area, and an outside bottom surface having a solar panel set thereinto which is electrically connected to a light bulb and a battery located within the interior area of the shade; a switch operatively connected to the light bulb which can be closed when the device is made to rest on the bottom surface; wherein the solar panel charges the battery when the device is resting on the upper edge and wherein the battery powers the light bulb when the device is resting on the bottom surface and the switch is closed.

9 Claims, 6 Drawing Sheets

SOLAR POWERED CANDLE

This invention relates to a solar powered decorative light having a solar panel located on the bottom of its base which panel is not visible and does not charge the device until the candle is turned upside-down.

BACKGROUND OF THE INVENTION

Solar powered decorative lights are known in the art. See, e.g., U.S. Pat. Nos. 7,360,918 and 7,661,838. The problem with such solar powered lights, however, is that the solar panel is visible, as it must be in order to receive power from the sun, and the sight of the panel detracts from the attractiveness of the device.

SUMMARY OF THE INVENTION

The present invention is directed to a solar powered light in which the solar panel is located on the outside bottom of the base of the light. The light is inverted during the day for charging and is replaced in its proper orientation for use.

DETAILED DESCRIPTION OF THE INVENTION

Figure 2:
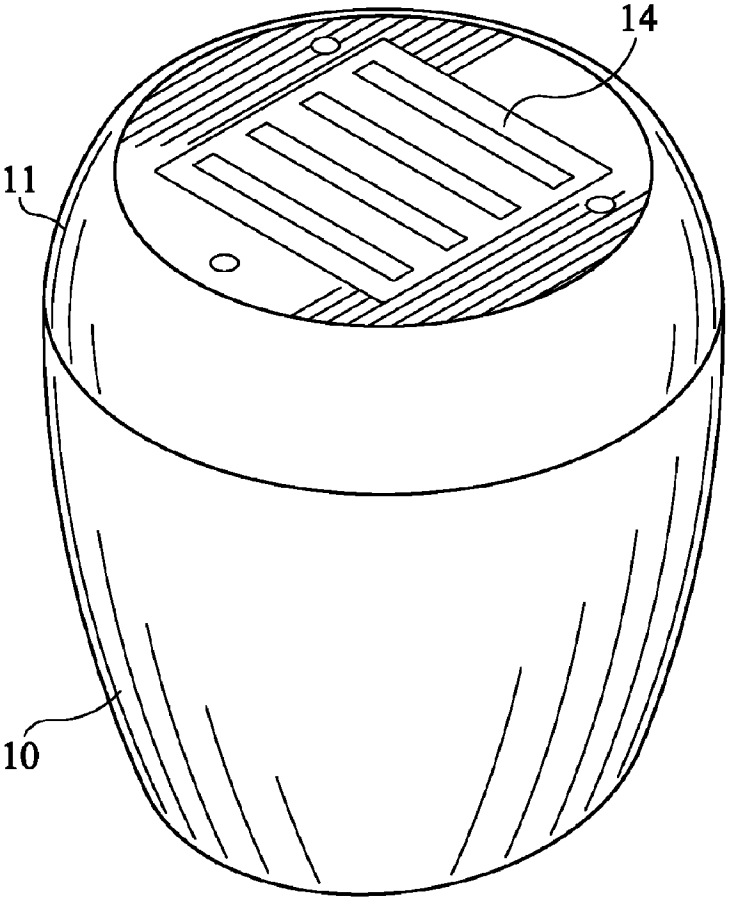
FIG. 2 is a perspective view of the embodiment shown in FIG. 1, in an inverted position.
Figure 1:
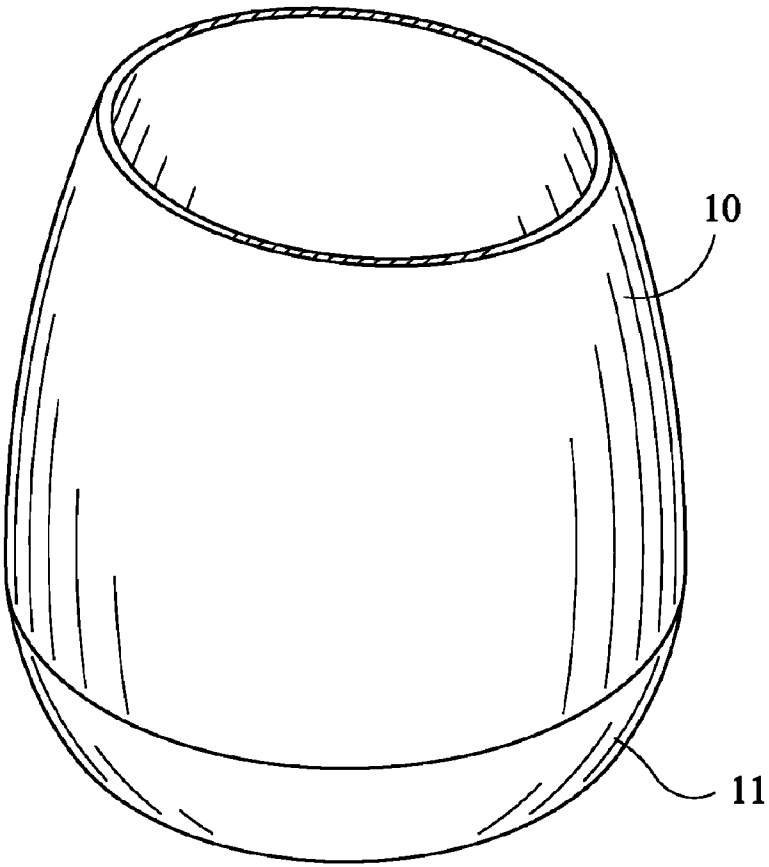
FIG. 1 is a perspective view of one embodiment of the solar powered light of the present invention.
Figure 3:
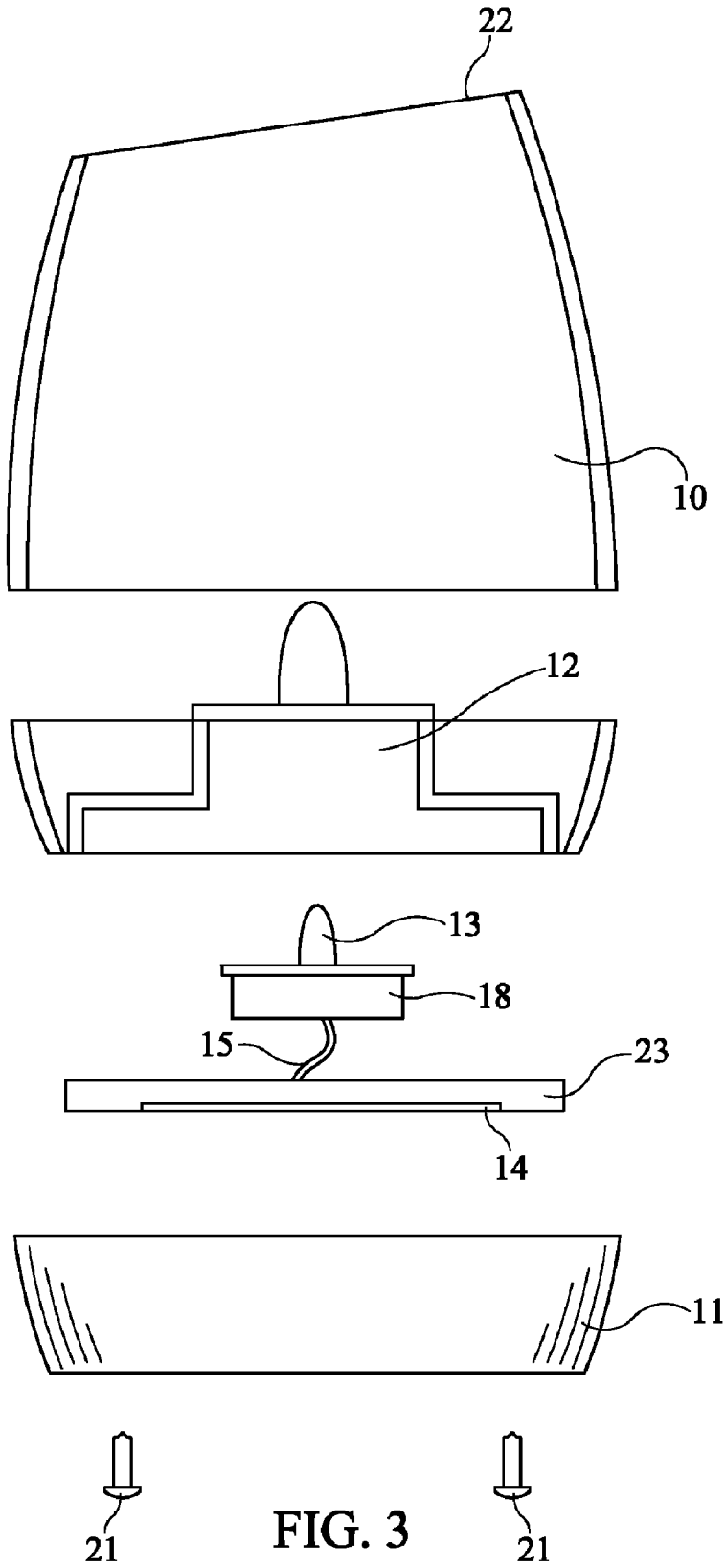
FIG. 3 is an exploded view of the embodiment shown in FIG. 1.
Figure 3A:
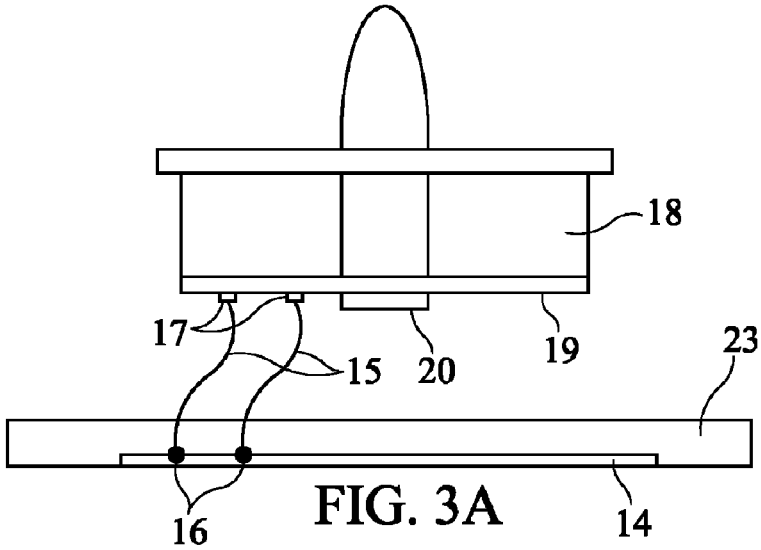
FIG. 3A is a cross-sectional view of the solar panel and bulb holder of the embodiment shown in FIG. 3.

FIGS. 1-3 and 3A illustrate one embodiment of a solar powered candle having its solar panel on the bottom of its base. As shown in FIGS. 2, 3, and 3A, solar panel 14 is set within the outside of bottom 23 of base 11. Wires 15 connect contacts 16 on solar panel 14 through circuit board 19 to bulb contacts 17 in bulb holder 18, located within bulb stand 12. Bulb stand 12 with bulb 13 are centrally placed on base 11 and are secured thereto using any convenient securing means, such as, e.g., screws 21. Bulb 13 may provide a constantly illuminated light or a flickering light, as desired. Shade 10 is placed within the circumference of base 11 and may be, e.g., clear, translucent, frosted, or opaque glass or plastic or crystalline material; perforated, patterned, or solid ceramic, metal, or paper; or any other material utilizable as a light shade.

In order to charge the device, the device is oriented as shown in FIG. 2, i.e., it is inverted and placed on the upper edge 22 of shade 10 so that solar panel 14 faces upward toward a light source, preferably the sun, so that panel 14 receives incident light energy which it converts to electrical energy in a manner well understood by those skilled in the art. The top of shade 10 may be slanted so as to allow more efficient orientation of solar panel 14 to the incident sunlight. The electrical energy generated at solar panel 14 is routed to battery 25 to be stored for future use.

Switch 20 is operatively connected between bulb 13 and battery 25 and in this embodiment is an inversion switch 20, known to those skilled in the art and comprising e.g., a mercury switch or a ball-bearing switch. Setting the device back on its base 11 causes inversion switch 20 to turn on, causing power to flow to and light bulb 13. When the device is set on edge 22 of shade 10, as shown in FIG. 2, inversion switch 20 turns off, turning bulb 13 off. When the device is set back on its base, the inversion switch closes, completing the circuit so that bulb 13 receives current and is illuminated.

Figure 3B:
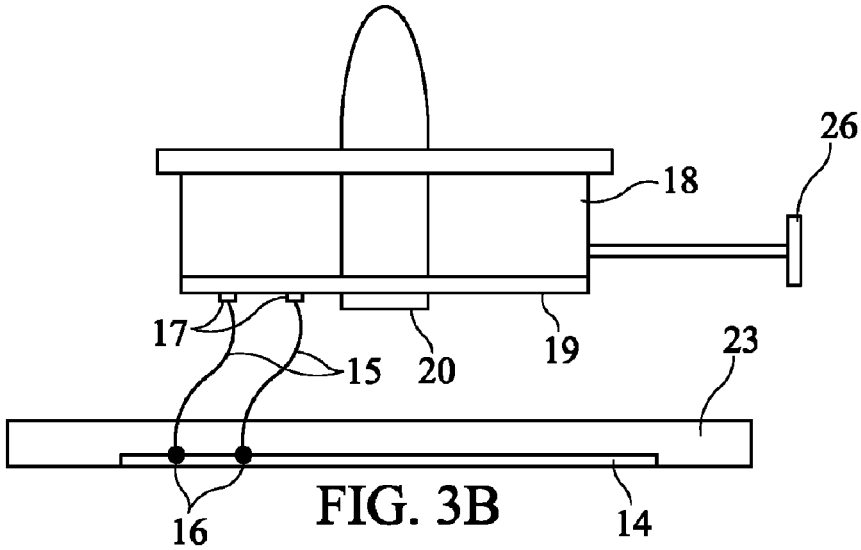
FIG. 3B is a cross-sectional view of the solar panel and bulb holder of an embodiment of the present invention having an externally operable switch.

In another embodiment, as shown in FIG. 3B, switch 26, operable on the outside of the device, is wired from the outside of the device to bulb holder 18 and is operatively connected to bulb 13. When the device is set back on its base after having been charged in an inverted position, switch 26 is activated causing current to flow to the bulb to illuminate it.

Figure 4:
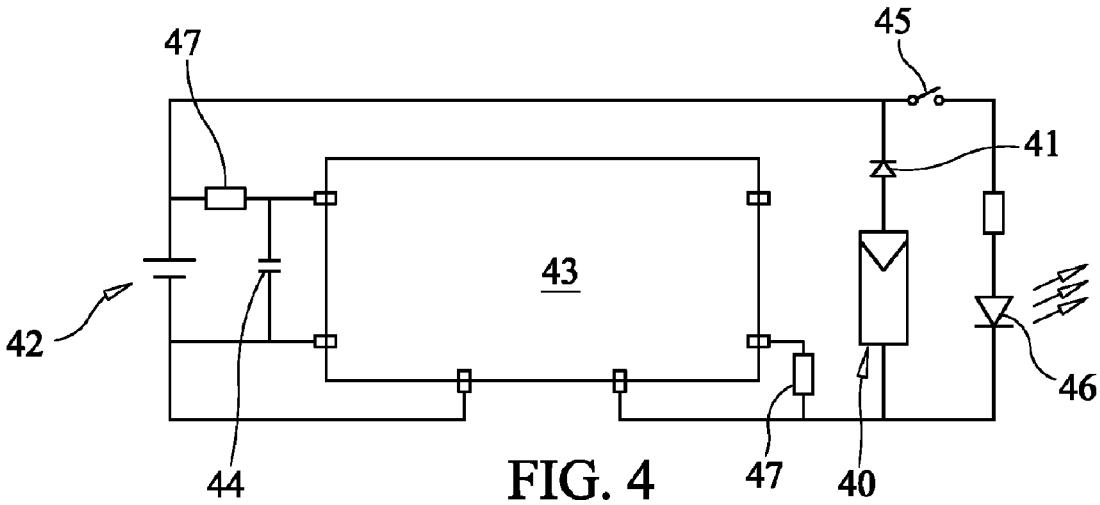
FIG. 4 is a circuit diagram of the embodiment shown in FIG. 1.

FIG. 4 shows a diagram of a circuit for use in the solar candle of the present invention. When the device is inverted so as the solar panel is oriented toward the sun, light hits solar cell 40 which transforms the incident light into current. Diode 41 regulates the current that is generated at solar cell 40 so that it flows in one direction, i.e., away from solar cell 40. The current travels through the circuit toward battery 42, which can be preferably a Li-ion battery. Integrated circuit 43, with resistors 47 and capacitor 44 as support components, monitors battery 42 so that it does not overcharge. When the device is inverted so that the solar panel is facing the sun, the user opens switch 45 to OFF, preventing the current from flowing to LED 46, but allowing the current to flow to and charge battery 42. When the device is placed on its base and the user closes switch 45, turning it ON, current is allowed to flow from battery 42 to LED 46.

Figure 5:
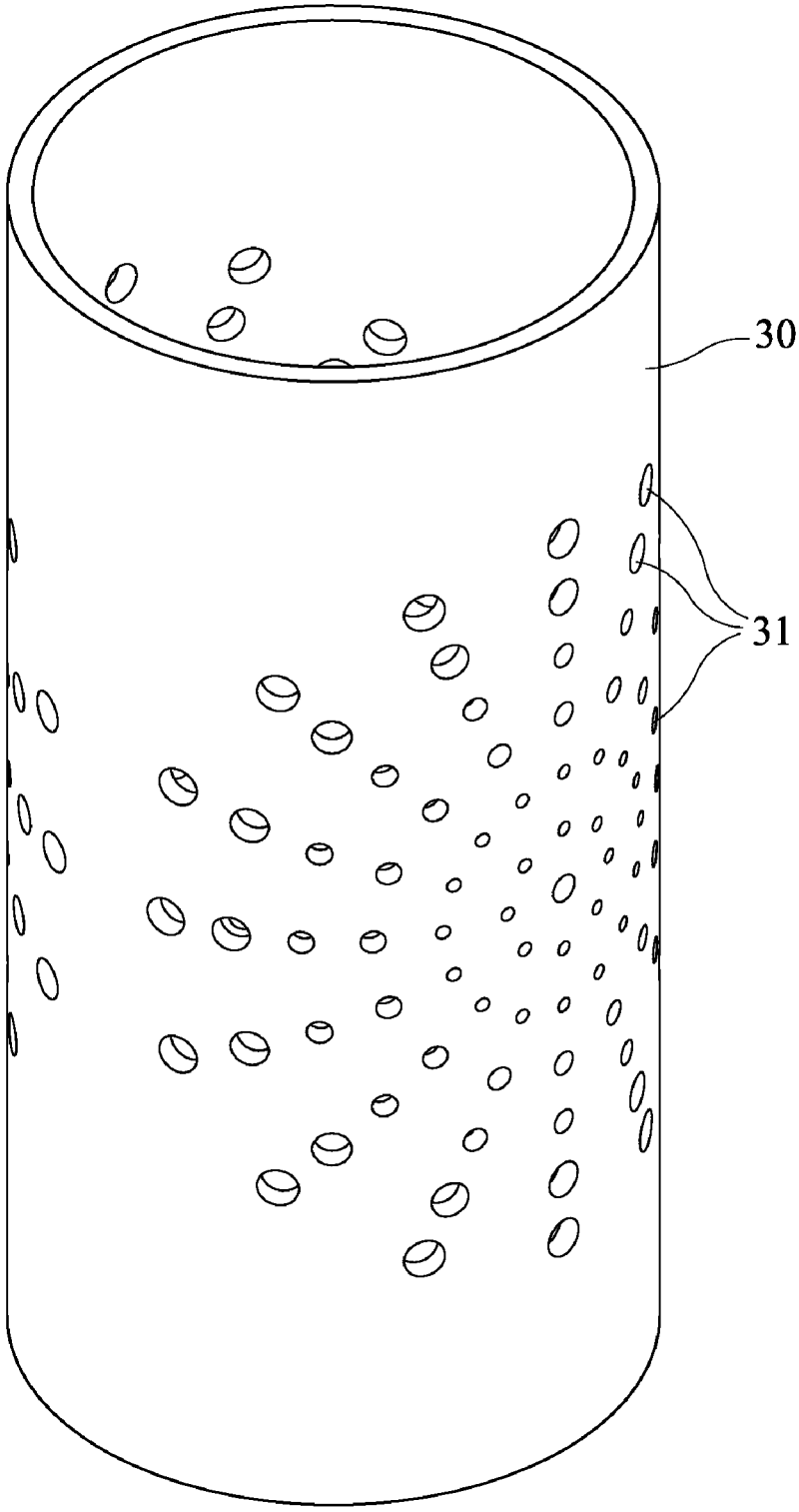
FIG. 5 is a top front side perspective view of a further embodiment of a solar powered light of the present invention.
Figure 6:
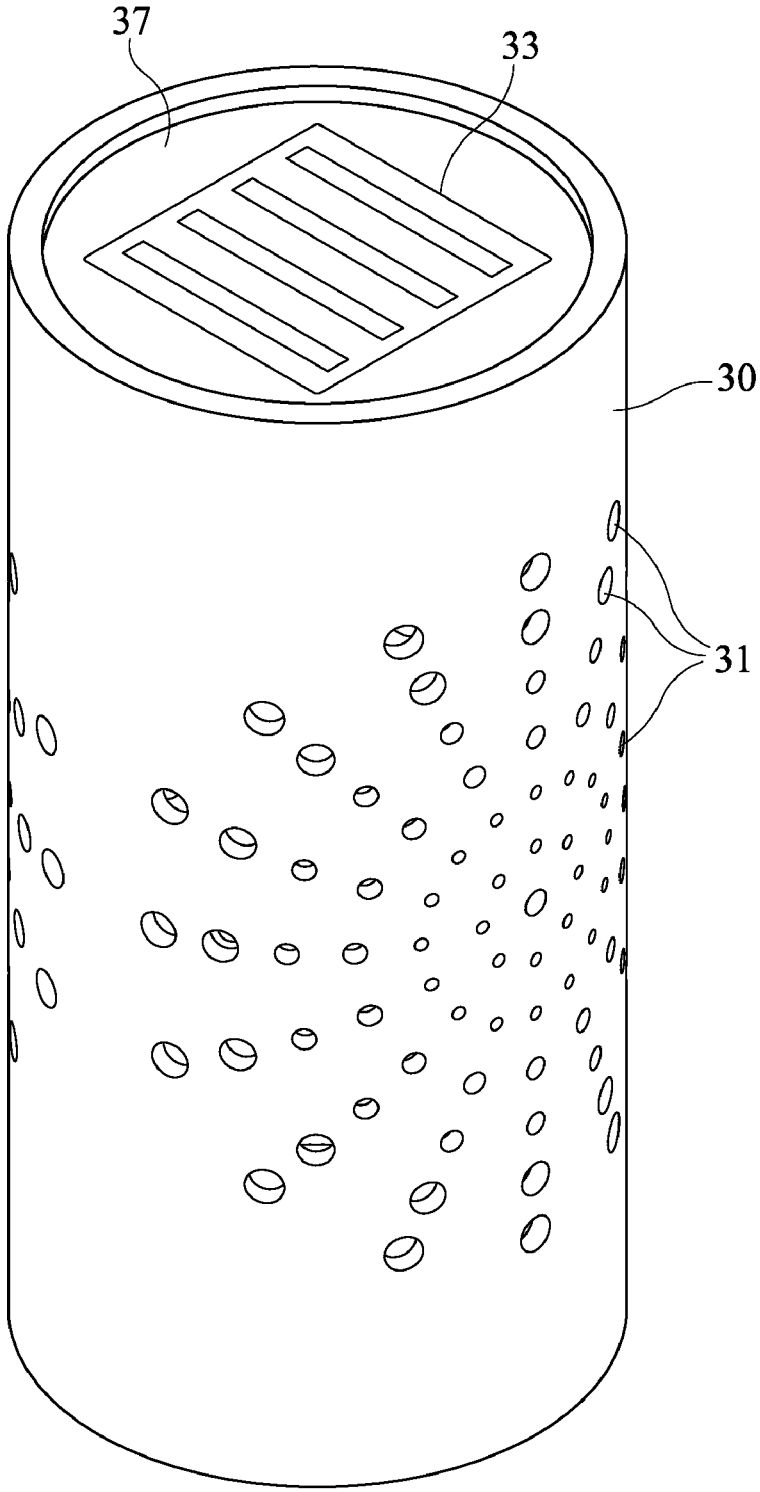
FIG. 6 is a bottom rear view of the embodiment of FIG. 5.
Figure 7:
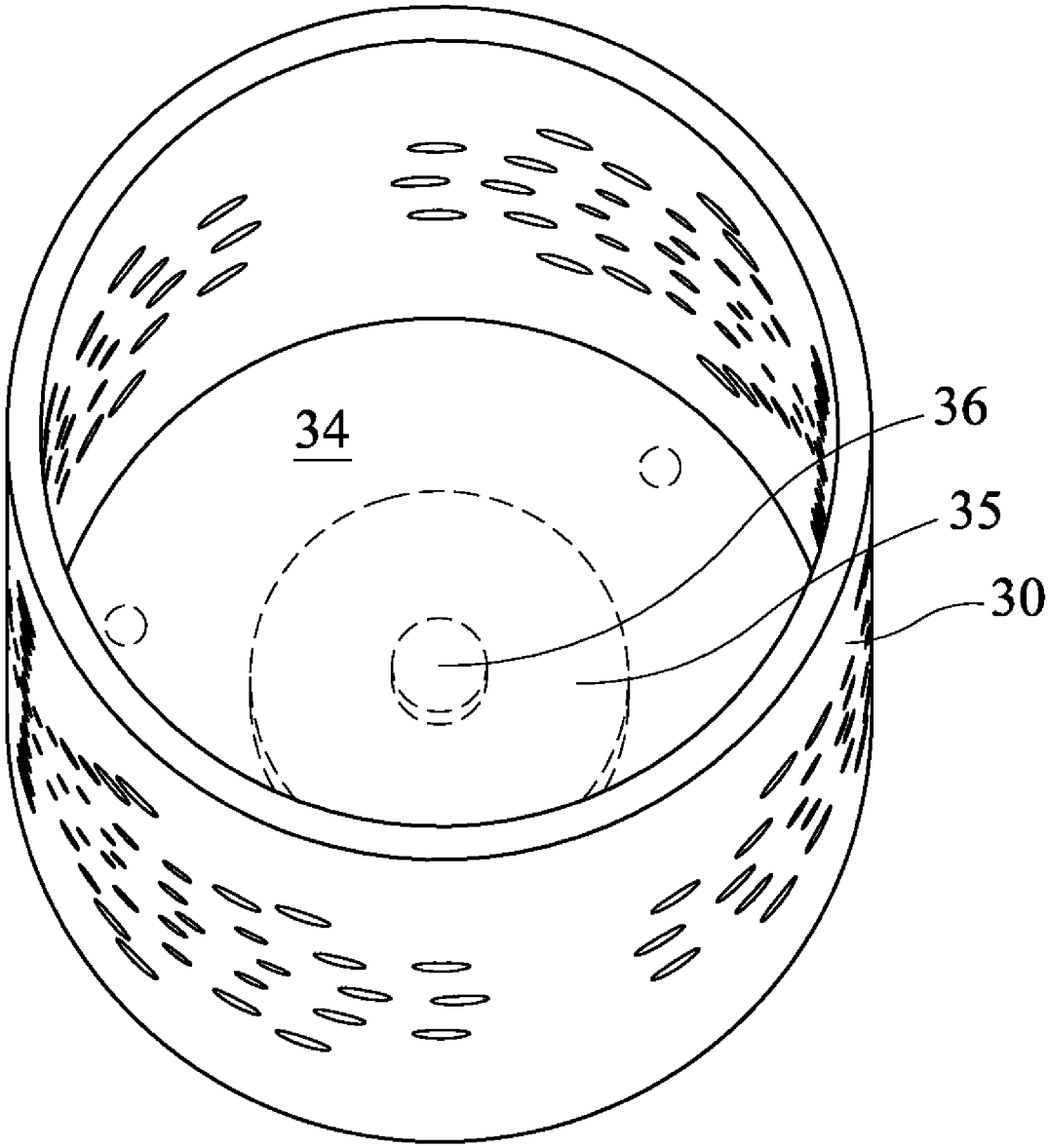
FIG. 7 is a top front side perspective view of the embodiment of FIG. 5, showing the interior of the embodiment of FIG. 5.

FIGS. 5, 6, and 7 show a second embodiment of the present invention, specifically, a tubular ceramic shade 30 having perforations 31 therethrough, with a floor 37 having a solar panel 33 affixed to the bottom thereof. A bulb stand 34 sits at the bottom of the interior of shade 30 on which bulb holder 35 is placed. Bulb 36 is located in bulb holder 35 and is operatively connected by wires through an inversion switch to solar panel 33.

The invention claimed is:

1. A solar powered light device comprising:

a shade having an upper edge, an interior area, and an outside bottom surface having a solar panel set thereinto which is electrically connected to a light bulb and a battery located within the interior area of the shade;

a switch operatively connected to the light bulb which can be closed when the device is made to rest on the bottom surface;

wherein the solar panel charges the battery when the device is resting on the upper edge and wherein the battery powers the light bulb when the device is resting on the bottom surface and the switch is closed.

2. A solar powered device according to claim 1 wherein the battery is a lithium-ion battery.

3. A solar powered device according to claim 1 wherein the switch can be operated from an area exterior of the shade.

4. A solar powered light device comprising:

a shade having an upper edge, an interior area, and an outside bottom surface having a solar panel set thereinto which is electrically connected to a light bulb and a battery located within the interior area of the shade;

an inversion switch operatively connected to the light bulb which closes when the device is made to rest on the bottom surface and which opens when the device is made to rest on the upper edge;

wherein the solar panel charges the battery when the device is resting on the upper edge and wherein the battery powers the light bulb when the device is resting on the bottom surface.

5. A solar powered device according to claim 4 wherein the battery is a lithium-ion battery.

6. A device according to claim 4 wherein the shade is translucent.

7. A device according to claim 4 wherein the shade is opaque with perforations.

8. A device according to claim 4 wherein the light bulb presents a flickering effect.

9. A device according to claim 4 wherein the light bulb is illuminated at a constant level.

* * * * *